US006048583A

United States Patent [19]

Waddell

[11] Patent Number: 6,048,583

[45] Date of Patent: Apr. 11, 2000

[54] METHOD OF APPLYING A LIQUID PROTECTORANT

[75] Inventor: Rickie Lee Waddell, Cedar Rapids, Iowa

[73] Assignee: Sunshine Sales, Inc., Cedar Rapids, Iowa

[21] Appl. No.: 09/014,809

[22] Filed: Jan. 28, 1998

[51] Int. Cl.[7] ..... B05D 1/28

[52] U.S. Cl. ..... 427/429; 401/288; 401/289; 15/29; 15/104.94; 118/304

[58] Field of Search ..... 427/429; 401/288, 401/289, 188 A; 15/29, 104.94; 118/304

[56] References Cited

U.S. PATENT DOCUMENTS

| | | | |
|---|---|---|---|
| 2,511,684 | 6/1950 | Amore | 401/289 |
| 2,806,236 | 9/1957 | DiStephano | 15/29 |
| 3,274,632 | 9/1966 | Franklin . | |
| 3,305,144 | 2/1967 | Beres et al. . | |
| 3,331,093 | 7/1967 | Mayden . | |
| 3,381,335 | 5/1968 | Schaedlich et al. | 15/29 |
| 3,760,447 | 9/1973 | Vivion | 15/29 |
| 4,168,560 | 9/1979 | Doyel | 15/29 |
| 4,252,455 | 2/1981 | De La Pena . | |
| 4,350,299 | 9/1982 | Stephenson et al. . | |
| 4,636,102 | 1/1987 | Drake . | |
| 4,848,946 | 7/1989 | Goncalves . | |
| 4,938,621 | 7/1990 | Pyrozyk . | |
| 5,567,073 | 10/1996 | De Laforcade et al. . | |
| 5,641,233 | 6/1997 | Wilson . | |

*Primary Examiner*—Katherine A. Bareford
*Attorney, Agent, or Firm*—Zarley, McKee, Thomte, Voorhees & Sease

[57] ABSTRACT

An apparatus and method for applying liquid protectorant to a targeted surface, such as a automobile tire sidewall, comprising a container for holding the liquid protectorant, a hand-held applicator, and a conduit between the container and the applicator. And one embodiment, the container is pressurized and a manually controllable valve is operable to deliver the liquid protectorant from the container to the applicator. The applicator includes a nozzle for delivering liquid protectorant. The nozzle, however, is surrounded by portions of the applicator, for example brush bristles, to prevent liquid protectorant from traveling to other than the targeted area.

18 Claims, 3 Drawing Sheets

METHOD OF APPLYING A LIQUID PROTECTORANT

BACKGROUND OF THE INVENTION

1. Field of the Invention

The invention was developed to apply substances such as Armor-All™ to such things as car tires when detailing the cars. Although the invention is not limited to this application, it is its primary focus.

2. Problems in the Art

The conventional way to apply such things as Armor-All™ is to either squirt it out of a standard manually pumped spray bottle (for example a Windex™ bottle) or to pour some of the fluid on a cloth or rag and swipe it on the surface to which it is to be applied. Even with the spray bottle, a cloth or rag is needed to wipe and smooth it out over the surface. There are times when the liquid needs to be penetrate somewhat into the surface of application, and mere wiping is insufficient.

A third method involves use of a sponge-type applicator such as liquid shoe polish or the like. It still usually requires some wiping or working with cloth. Foam applicators are sometimes used, but they deteriorate quite rapidly due to the rough surfaces of tires, and the lettering found on many tires.

The problems with these techniques is that they generally require the two-step process of dispensing the fluid from its container and then wiping it on or working it into the surface. They also create a subtle but significant problem of having the substance on rags or applicators which in turn then causes the user's hands to come into contact with the substance. It also results in spillage of the substance.

The problem with the above is that if the user's hands come in contact or the rags or towels come in contact with the liquid, it is difficult to clean and can drip or be transferred to floors and make them slippery. It can also be damaging to the user's skin. Some of these substances are dangerous if exposure to eyes or skin occur, or if inhaled through the nose or ingested into the lungs.

Further, the above application methods tend to utilize a lot of the substance (more than is needed for the surface) and therefore a significant amount of liquid and thus a significant amount of cost is involved in the application of the substance.

There are a variety of different types of vinyl and rubber protectorant fluids. Examples are Armor-All™ Protectorant of Armor-All™ Products Corporation of Aliso Viejo, Calif.; ReTire from Zep Products, of Smyrna, Ga.; and Ultra Shine Tire Protectorant from Grace-Lee Products, of Minneapolis, Minn. Most of them are packaged in relatively small hand-held sized plastic bottles. Some of the containers simply have screw off caps. The substance is poured onto a rag or other applicator. The substance is then wiped and/or worked onto a targeted surface, such as, for example, a car tire or other vinyl or rubber parts of an automobile. Using this process, it is very hard to regulate the amount of fluid that is dispensed out of the bottle that should be commenced with the needs of the targeted surface. In other words, the user just estimates how much to pour onto the applicator. Because most applicators are absorbent, any excess is either inefficiently placed on the target surface, or retained in the absorbent applicator. However, in both cases many times too much of the fluid is dispensed.

Furthermore, the steps of pouring fluid onto an applicator, then moving the applicator to a surface, and then wiping the applicator on the surface all involve possible spillage. Also, the applicator either has a limited life span, or must be cleaned from time to time. If a rag, this means it must be washed, for example in a washing machine. The types of liquid protectorants discussed, are not necessarily environmentally friendly. Therefore, if the substance is able to be removed from the cloth or towel, it then enters the water and is placed into the water system of the municipality. Otherwise, the applicator must be washed under a hose or other facilities and again the substance would enter the municipal water system or fall or run off to the ground and also could enter ground water. Such substances are also potentially hazardous because if spilled on the floor, they can create slippery areas. Workers or customers would be exposed to this risk. The substances may produce environmentally hazardous substances when decomposing.

Other conventional types of containers for such fluids may incorporate in the hand-held bottle a spray nozzle with a manually pumped delivery system. Dispension of the fluid is therefore arguably easier, as is control over dispension of the fluid. However, the spray is generally not fine in nature. The amount of control is also not precise. This results in either an inefficient amount of the substance being applied to the surface, or spillage, splattering, dripping, or misdirection of the spray; again resulting in waste of the fluid as well as creating possible negative environmental consequences. Moreover, even using the spray dispensers requires the second step of then wiping the substance over the targeted surface. Similar problems regarding use of such an applicator therefore occur.

It should also be mentioned that most hand-held sized containers hold a relatively small amount of the fluid. This is especially inefficient for businesses that use a relatively large amount of the fluid over the course of a day. It requires a change-over of containers frequently as well as the uneconomic of paying for a large number of containers. Thus, the convenience of having a small hand-sized container, including the maneuverability of the same, is countervailed by the small amount of fluid that it can contain as well as the problems with imprecise amounts of fluid used and spillage.

OBJECTIVES OF THE INVENTION

The primary object of the invention is to improve upon the problems and deficiencies in the art. For example, improvement is needed in eliminating the wiping step with towels, rags, or sponges. Also it would be very beneficial to eliminate any human contact with the substance. It is important to decrease the amount of substance used.

It is therefore a principal object of the present invention to provide a method and apparatus which solve or improve over the problems and deficiencies in the art.

Further objects, features, and advantages of the present invention include a method and apparatus which:

a. Allow more precise control placement of the fluid on a targeted surface in an appropriate amount.

b. Allow better dispension of fluid from a holding container.

c. Reduce spillage, drips, or inaccurate placement of the fluid.

d. Deter potential hazards of spillage of the fluid on the working area, which can render it slippery, or to the user.

e. Deter and reduce adverse environmental effects of the fluid.

f. Provides a substantial amount of fluid in a portable manner readily available for delivery to an applicator.

g. Are durable.

h. Are refillable.

i. Are easily repairable and maintained.

j. Are efficient and economical.

k. Are easily handled and maneuvered manually by a worker and do not constrain free movement around a vehicle or targeted surface.

These and other objects, features, and advantages of the present invention will become more apparent with reference to the accompanying specification and claims.

SUMMARY OF THE INVENTION

The present invention relates to an apparatus and method for applying liquid protectorant to a targeted surface. The apparatus consists of a container for holding a supply of liquid protectorant. A hand-held applicator is in fluid communication with the container through a conduit. A controller, which can meter the amount of fluid passing from the container to the applicator, is operatively connected to the apparatus. The applicator includes an application head. A nozzle is surrounded by the application head but has sufficient excess space around the nozzle so that fluid can be sprayed substantially directly to the targeted surface but is constrained from traveling to places other than the target surface when the applicator is placed on or near the targeted surface.

The container applicator and conduit are operable by hand and portable. Thus, in one step via a delivery system, the fluid in the container is dispensed and delivered to the applicator nozzle. When the applicator is placed on the targeted surface, the fluid can be directed only to the surface and in quantities controllable by the controller. The applicator can at the same time wipe, spread or work the dispensed fluid across and/or into the targeted surface while maintaining the fluid on the targeted surface.

The method according to the invention includes containing a relatively large supply of liquid protectorant in a manner that is hand portable, conveying the liquid in a controlled matter to a targeted surface while surrounding the dispensing of the fluid to prevent spillage or direction of the fluid outside the targeted surface and spreading the dispensed liquid across the targeted surface.

DETAILED DESCRIPTION OF THE PREFERRED EMBODIMENT

Figure 1:
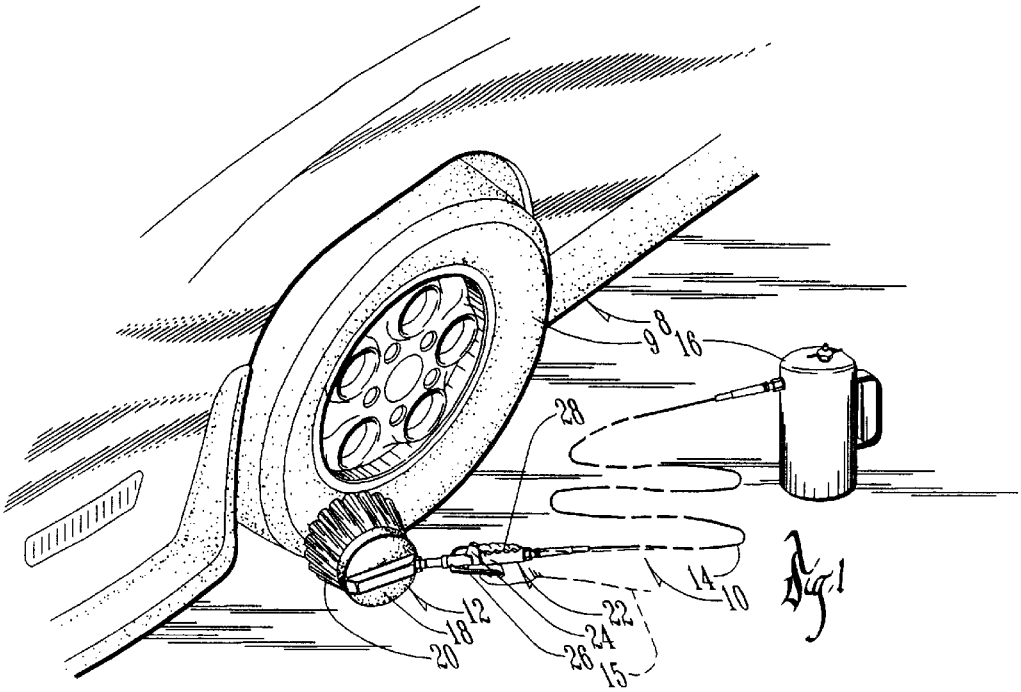
FIG. 1 is a perspective view of a preferred embodiment of the invention, including a partial perspective view of an automobile tire and illustrating the hand-held nature of the apparatus.

In order to provide a better understanding of the invention, one embodiment of the invention will now be described in detail. Frequent reference will be taken to the drawings. Reference numbers will be used to indicate certain parts and locations in the drawings. The same reference numbers will be used to indicate the same parts and locations throughout the drawings unless otherwise indicated.

It is to be understood that the preferred embodiment is but one form and configuration the invention can take. This detailed description is neither intended nor does it limit the invention, which is solely defined by claims set forth herein.

The basic structure and environment of the invention will first be described, followed by more detail of the structure of the preferred embodiment of the invention, followed by a description of the operation of the preferred embodiment, and finally, concluded with a discussion of exemplary options, features, and alternatives with regard to the invention.

By referring to FIG. 1, an automobile 8 is illustrated along with an associated tire sidewall 9. Automobile detailing businesses sometimes utilize vinyl or rubber protectorant fluid to clean, protect, and improve the aesthetic appearance of automobile tires. Businesses involved in the same therefore utilize substantial quantities of the protectorant.

FIG. 1 shows a preferred embodiment of the invention. The device 10 includes a brush applicator (indicated generally at reference number 12) connected via hose 14 to a pressurized, hand-held canister 16. The substance to be dispensed (e.g. Armor-All™) is in pressurized canister 16.

The liquid protectorant is generically described as a vinyl and rubber protectorant fluid. Such fluids are well-known in the art. The specific composition of such fluids is not pertinent to the invention other than the fact that when spilled on the floor they can be slippery and that they are not necessarily environmentally or user friendly. FIG. 1 illustrates that the user can grip applicator 12 by hand (see reference number 15) and manipulate brush applicator 12 relative to tire sidewall 9 in an easy and efficient manner.

The brush applicator 12 is comprised of a head 18, bristles 20 extending from head 18, a handle (generally indicated at 22) that comprises a hollow conduit, a valve 24 along conduit 22 and an exterior gripping portion 28. A hand lever 26 operates valve 24. By pushing lever 26 towards conduit 22, valve 24 increasingly opens and provides a fluid conduit pathway from hose 14 to head 18. Then lever 26 is in this normal, undepressed position, the fluid pathway through valve 24 is blocked or closed.

Canister 16 includes a main body 30, coupling 32 for hose 14, a hand grip 34, a 15/16" hex release valve/filling cap 36, and an air filling valve/cap 38. Protectorant can be placed into canister 16 by removing cap 36. The interior of canister 16 can be pressurized by removing cap 38 (when cap 36 is in place on canister 16) and adding pressurized air through 38. Pressure can be adjusted or released through valve 36. Caps 36 and 38 are threadably attached in place.

Figure 2:
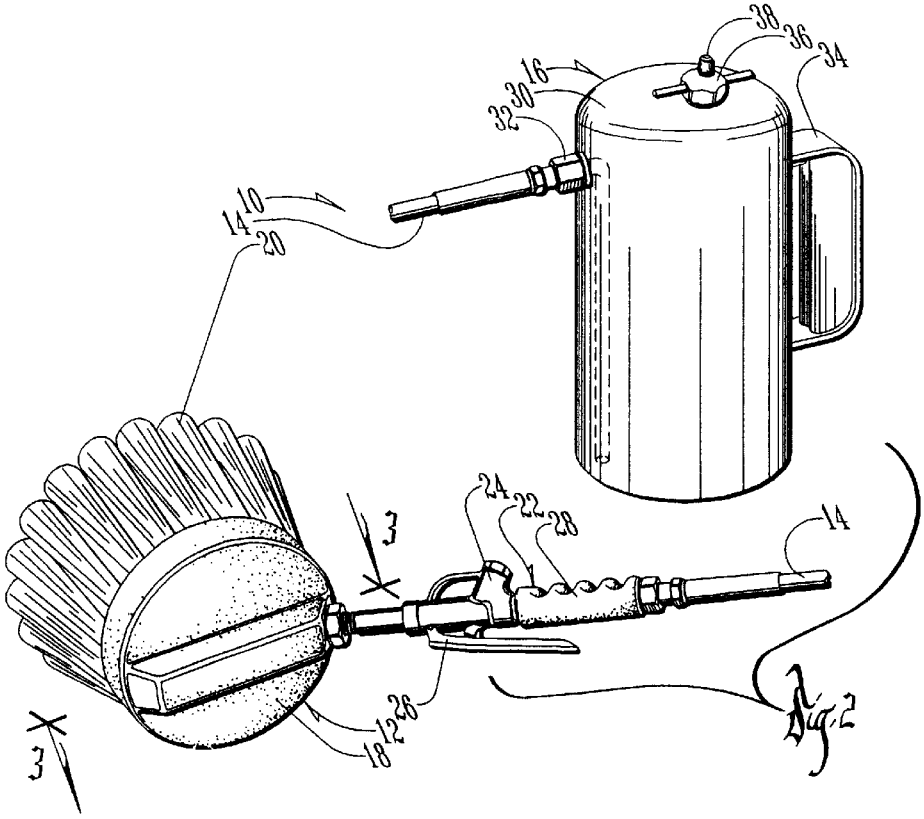
FIG. 2 is an enlarged perspective view of the preferred embodiment of FIG. 1.

FIG. 2 shows in apparatus 10 in enlarged detail.

Figure 3:
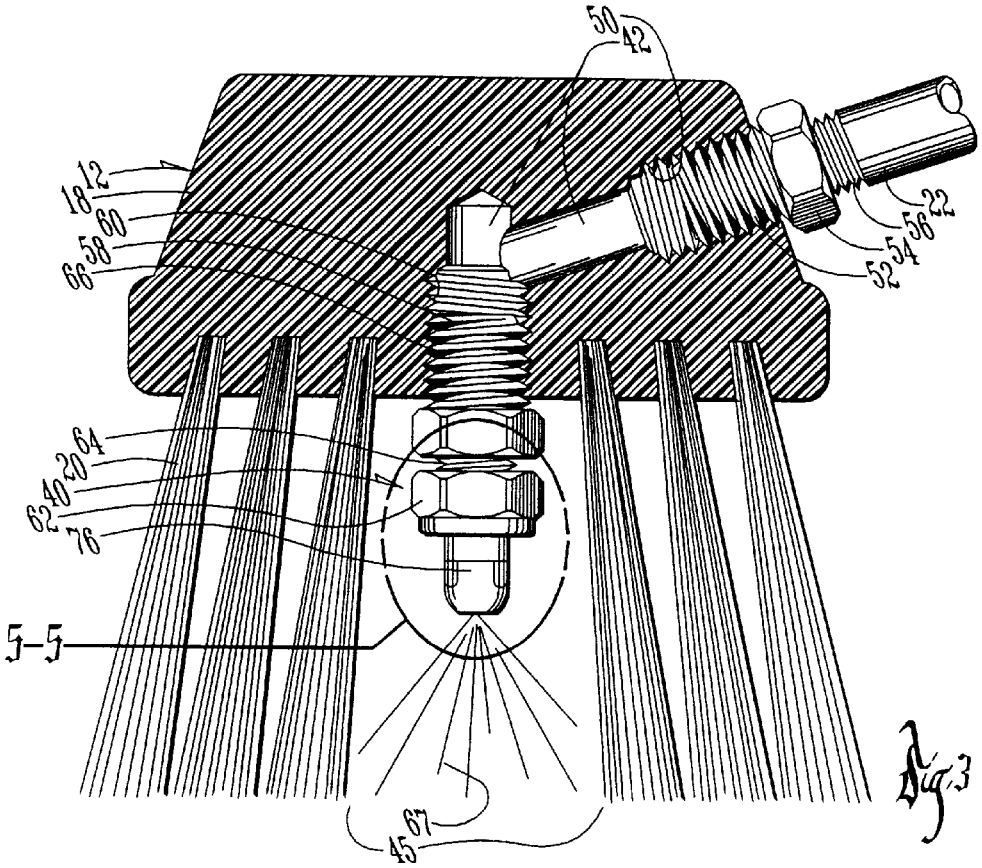
FIG. 3 is an still further enlarged sectional view taken along line 3—3 of FIG. 2.
Figure 4:
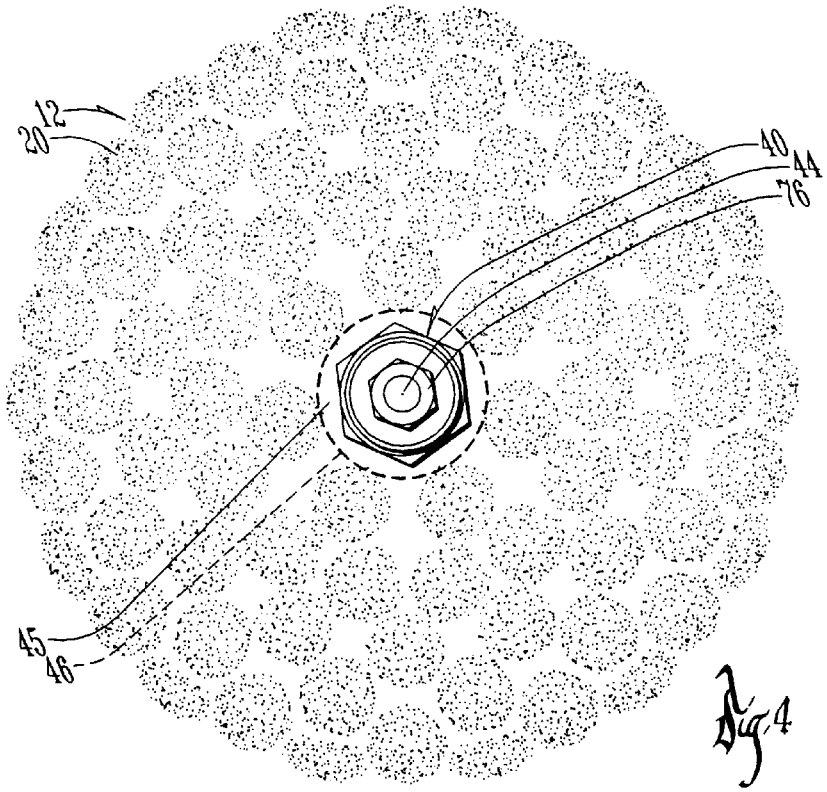
FIG. 4 is a bottom plan view of FIG. 3.

FIGS. 3 and 4 illustrate that a conduit 42 is formed in and extends through head 18 into a nozzle 40 from conduit 22. Nozzle 40 is basically centered in the middle of bristles 20 and extends at least approximately halfway from head 18 through bristles 40. It is furthermore noted that nozzle 40 has a very small aperture 44 through which the fluid can be disbursed.

It is further important to note that there is intentionally an open area 45 around nozzle 40 (extending from the bottom of head 18 to the distal ends of bristles 20). Dashed line 46 is used to indicate that open area where no bristles 20 exist.

Head 18 can be made of plastic material. One end of conduit 42 would comprise threaded aperture 50 which receives the threaded male end 52 of connector 54, which in turn can receive a male threaded end 56 of handle 22 into a threaded aperture therein. It should be noted that the fittings comprising 52, 54, and 56 can be made of metal, for example brass or other corrosion resistant metals. Furthermore, to provide a sealing action against leakage, Teflon tape can be utilized between threaded parts, such as known in the art. An alternative is nitrile tape. Use of such materials is beneficial because rubber seals such as (rubber O-rings), could be corroded by the liquid protectorant.

Nozzle 40 has a male threaded into 58 that fits within the female thread of aperture 60 at the other end of conduit 42 in head 18. As can be seen further in FIG. 6, nozzle tip 62 in turn can be threaded via its male threaded end 64 into the other part of nozzle 40 indicated at reference number 66.

As illustrated by lines 67, nozzle 40 functions to mist or spray liquid protectorant delivered through conduit 42 in a manner that would exit open area 45. Bristles 20 would essentially surround, by 360°, nozzle 40 and therefore fluid could not pass through bristles 20 and thus is constrained to pass out of opening 45 or strike the innermost bristles 20 relative to nozzle 40.

Figure 5:
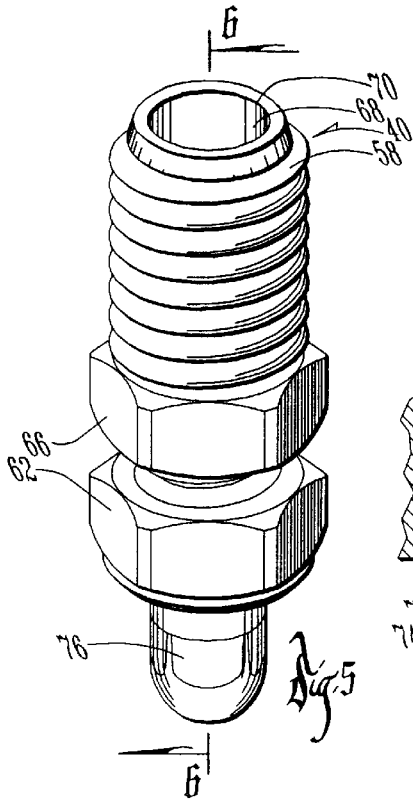
FIG. 5 is an enlarged isolated perspective taken along line 5—5 of FIG. 3.
Figure 7:
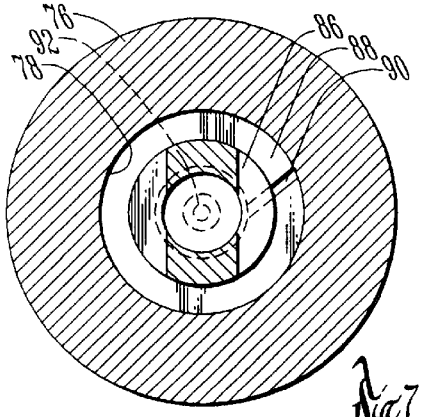
FIG. 7 is an sectional view taken along line 7—7 of FIG. 6.
Figure 6:
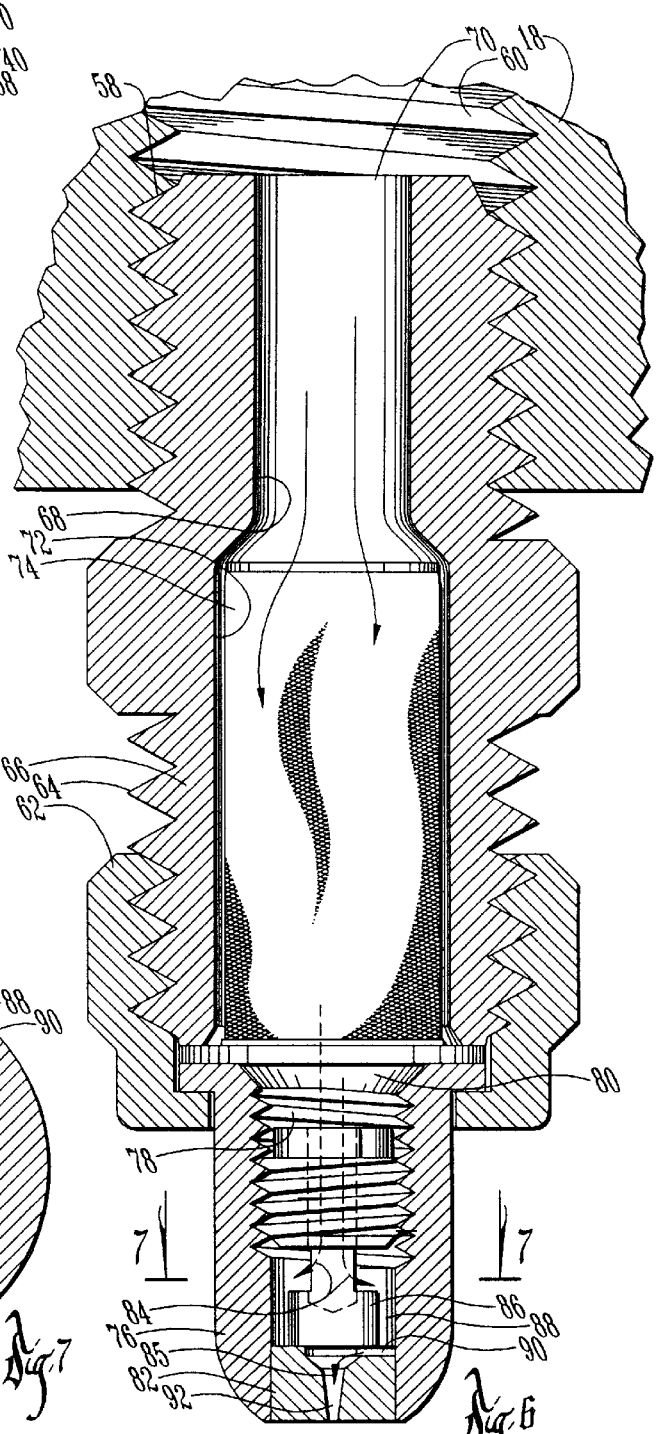
FIG. 6 is an enlarged sectional view taken along line 6—6 of FIG. 5.

FIGS. 5–7 illustrated in detail of the structure of nozzle 40. It is pointed out that nozzle 40 is easily replaceable and removable for maintenance and cleaning. It is also removeable to interchange nozzle size and for spray characteristics. By referring particular FIG. 6, it can be shown that portion 66 of nozzle 40 includes a bore 68 having an upper open end 70. Bore 68 increases somewhat in diameter at its lower portion (see reference numeral 72). In portion 72 of bore 68 is a screen 74 that is annular is shape and covers the bottom end of bore 68.

As can be seen in FIG. 6, the very tip 76 of nozzle 40 has a bore 78 longitudinally therethrough with an upper end 80 in fluid communication with bore 68. An insert 82 is threaded into tip 76. Dashed lines 34 and 85 illustrate the flow path of fluid through insert 82. The fluid is allowed to travel longitudinally along nozzle 40 until the location indicated at 86 which blocks further axial movement. Fluid has to travel around sides of part 86 (see annular void 88 in FIG. 7, and then enter channel 90 where it flows out increasingly constricted pinhole 92.

The detailed structure of nozzle 40 is discussed for the following reason. By utilizing such a nozzle, the fluid first must pass in pressurized fashion through screen 74. This filters out any solid particulars and serves to break up the fluid. The fluid is then forced through increasingly smaller passage ways until it finally must travel around part 86 and through very small channel 90 and then out an increasingly constricted pinhole 92. The cooperation of these elements therefore causes good aeration and essentially atomizing or misting as it leaves pinhole 92. By doing so, economy in the use of the fluid is achieved along with the efficiency of use of fluid.

Operation of device 10 is shown by referring to the Figures and is as follows. The combination of FIG. 1 is assembled. The fluid to be dispensed is placed into canister 16 by filling cap 36. Cap 36 is sealingly replaced, cap 38 is removed, and canister 16 is pressurized or charged through conventional valve 38 (with valve core) (through a standard air chuck operatively connected to the air stem valve 38 via a bicycle pump or other pressurized air source). Valve 38 is identical to an air valve on a bicycle tire. Nozzle 40 has been pre-designed to extend downwardly the distance relative to the length of bristles 20. It is noted that a benefit of this is that if the user presses bristles 20 too hard on a surface, the distal end of nozzle 40 would prevent complete bending and possible deformation or damage to bristles 20 or when bristles rebound, deters splattering.

The head 18 has been designed so that bristles 20 are approximately 2½ inches in length. They are intentionally selected to be of the type that have a soft edge that tends to absorb some of the product like a sponge.

Nozzle 40 extends approximately 1¼ inch down through bristles 20. The unobstructed area 45 around nozzle 40 is approximately 1 to 1½ inches wide. The remainder of the bristles 20 occupy the remainder of the approximately 4½ inch diameter of brush head 18.

Nozzle opening 44 is very small, almost pinhole size. Examples are #2 (0.025" diam.) and #4 (0.050" diam.) nozzle sizes; #2 for lighter fluids and #4 for heavier fluids. It is preferred that liquid lighter than No. 10 motor oil be used with device 10. If the liquid is too heavy, more of a pin-stream than a mist is produced. Therefore, if the liquid is too heavy, one might dilute it or use a slightly larger hole size for nozzle opening 44 (e.g. #2 for lighter fluids and #4 for heavier fluids).

Canister 16 is pressurized to maximum pressure of 200 psi. The maximum liquid capacity is 32 ounces. It has been found that 40 psi is about the minimum pressurization for good operability.

The combination of the pressurization of the fluid and the pinhole opening 44 results in a mist-like or almost vaporized discharge of the fluid through nozzle 40. The unobstructed space around nozzle 40 allows the misted fluid to get to the surface and then the brush bristles are used to spread it out evenly thereover.

As seen in FIG. 1, canister 16 handled 34 can be gripped with one hand of the user and applicator 12 with the other hand of the user. The user can then efficiently walk to automobile 8 and tire sidewall 9 and easily place the brush bristles 20 directly to sidewall 9. The bristles should be gently placed on sidewall 9, preferably at the middle of one side of the tire.

Lever 26 can be depressed and released to discharge the misted fluid for short bursts and then released to allow the brush to apply it to the surface. The fluid should be applied sparingly and the brush gently moved clockwise following the outer edge of the rim of the tire until a 360° pass has been made. Then the brush is moved counter-clockwise around the outer edge of the sidewall for another 360°. If needed, several other short pulls of the trigger can be made to provide a little more fluid. The whole tire is covered with two passes. Starting and finishing at the middle prevents drips on the floor or on the tire.

Once the protectorant fluid is dispensed onto a portion of sidewall 9, while bristles 20 protect against any liquid going to an area other than the targeted part of sidewall 9, the user can quickly and easily wipe or brush 20 around sidewall 9. The brush allows the liquid to be worked into the targeted surface. Short bursts of trigger 26 can be made according to need and experience to dispense appropriate amounts of liquid protectorant on sidewall 9 and simultaneously wipe and work the protectorant comprehensively around the sidewall 9. Once entire sidewall 9 has been treated, the user can easily move apparatus 10 to the next tire or location.

It will be appreciated the present invention can take many forms and embodiments. The true incense and spirit of this invention are defined in the impended claims, and it is not intended that the embodiment of the invention presented here and should limit the scope thereof. Variations obvious to one skill in the art will be included with the invention, within the invention defined by the claims.

For example, the type of nozzle can vary according to need and desire. In the preferred embodiment, the nozzle mists or atomizes or vaporizes the fluid. In certain circumstances, more volume and less misting of the fluid may be desirable.

The exact position of the nozzle 40 relative to the brush bristles, including open area 45 in relationship of the distal end of nozzle 40 relative to the applicator head 18 and the distal head end of bristles 20, can be varied according to need. Bristles 20 can, for example, be flag-brush. They can have a fine but soft edge and have some absorbent qualities.

Container 30 can be a metal canister, preferably stainless steel. It specific size can be varied according to need and desire, but it is preferred that it be easily portable by gripping and moving in a hand-held manner. Different delivery systems could be used including aerosol or by attachment to a central pressurized distribution system.

The grip 28 for handle 22 can be ½" rubber hose or a formed handle grip. It is preferred that handle 22 be relatively short to allow for greater flexibility and maneuverability of head 18 relative to targeted areas. Conduit 14 is preferred to be flexible but made of an material that resists corrosion by material such as those used with the invention. An example such hoses are those that are used to apply acidic fluids.

Alternatively to canister 16, a larger container or a pressurized air source could be used to push the product through the brush. It is even possible to attach a plurality of brush applicators 12 by a plurality of hoses 14 to a centralized source of pressurized fluid. Hose 14 can be short or long. Examples are 5', 10' and 25'.

The valve 24 is placed near the brush applicator 12 instead of at the canister 16 to eliminate any run-on of pressurized fluid if the valve was at canister 16 and turned off. In other words, having the valve at or near brush applicator 12 allows quicker on/off of fluid discharge and therefore less waste of material.

Therefore, the device can apply a precisely controllable, economical amount of the fluid, and allow it to be spread evenly and thoroughly, without any need for contacting the user or being placed on any intermediate applicator, such as a cloth. The mist is contained within the open area of the brush bristles so as not to be wasted on other than the surface intended, furthermore allowing a more economical and efficient application of the substance.

It has been the experience of the inventor that an up to 80% savings in the amount of fluid to be used (in this example Armor-All™) can be realized. This translates in substantial economic savings.

By way of another example, it is the experience of the inventor that in traditional methods, 4 ounces of liquid protectorant are used per car (all four tires). But with the present invention this amount has been reduced to approximately ½ ounce per car. Considering that an automobile detailing company might go through over 50 gallons of liquid protectorant in a week, the amount of savings cumulatively is substantial. Also, expense, time and labor of washing rags or applicators is eliminated or reduced, cleaning up spills, and damaging environment, users, or non-targeting areas is reduced.

What is claimed:

1. A method of applying a liquid protectorant to a targeted surface comprising:

containing a supply of liquid protectorant in a manner that is portable;

conveying the liquid from the contained supply in a contained manner to a hand-held application head comprising a brush head with brush bristles;

placing the application head on or near the targeted surface;

applying the contained and conveyed liquid protectorant to the targeted surface by;

dispensing liquid from the application head;

controlling the dispensing of liquid from the application head so that liquid is directed to the targeted surface and blocked from traveling to non-targeted surface or areas;

spreading the dispensed liquid with the application head while containing the liquid to the targeted surface;

so that the storage, delivery and dispensing of the liquid protectorant is controlled and without exposure of the liquid to non-targeted surfaces or areas.

2. The method of claim 1 wherein the supply of liquid is at least several tens of fluid ounces.

3. The method of claim 1 wherein containing the supply of liquid from container to application head comprises sealing a delivery path therebetween.

4. The method of claim 1 wherein the targeted surface is selected from the set consisting of vinyl and rubber.

5. The method of claim 4 wherein the targeted surface is a portion of an automobile.

6. The method of claim 5 wherein the automobile portion comprises a tire portion.

7. The method of claim 1 wherein the liquid protectorant comprises a silicone-containing composition.

8. The method of claim 1 wherein the portable supply of liquid protectorant is hand portable.

9. The method of claim 1 wherein the step of conveying comprises utilizing air pressure to move the liquid protectorant.

10. The method of claim 1 wherein the step of dispensing of the liquid comprises misting the liquid.

11. The method of claim 1 wherein the step of controlling dispensing comprises operating a valve.

12. The method of claim 1 wherein the blocking step comprises surrounding the location of dispensing of liquid.

13. A method of application of a liquid protectorant comprising:

spraying misted liquid protectorant onto an area through a brush as the brush is at or near the area of application;

brushing the liquid over the area of application;

delivering the liquid to the brush via a sealed conduit from a hand portable liquid containing unit.

14. The method of claim 13 wherein the liquid protectorant is a silicone-containing composition.

15. The method of claim 14 wherein the misted liquid is atomized.

16. The method of claim 15 wherein atomization is accomplished by passing the liquid through an increasingly smaller space and aerating the liquid.

17. The method of claim 13 wherein the step of brushing comprises utilizing a brush with flag brush bristles.

18. The method of claim 13 wherein the step of delivery of the liquid is by air pressure.

* * * * *